US006488972B1

(12) United States Patent
Cerani

(10) Patent No.: US 6,488,972 B1
(45) **Date of Patent: *Dec. 3, 2002**

(54) HERMETICALLY SEALED PACKAGE, AND METHOD AND MACHINE FOR MANUFACTURING IT

(75) Inventor: Luca Cerani, Milan (IT)

(73) Assignee: Cryovac, Inc., Duncan, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/214,819

(22) PCT Filed: Jul. 4, 1997

(86) PCT No.: PCT/EP97/03640

§ 371 (c)(1),
(2), (4) Date: Jan. 25, 1999

(87) PCT Pub. No.: WO98/01363

PCT Pub. Date: Jan. 15, 1998

(30) Foreign Application Priority Data

Jul. 8, 1996 (EP) ..... 96110976

(51) Int. Cl.[7] ..... A23L 1/315; B65B 53/00; B65D 85/00

(52) U.S. Cl. ..... 426/110; 426/129; 426/644; 426/396; 426/410; 426/127; 53/441; 53/442; 53/556; 53/557; 206/497

(58) Field of Search ..... 426/110, 129, 426/644, 652, 396, 410, 412, 127; 53/556, 441, 557, 442; 206/497

(56) References Cited

U.S. PATENT DOCUMENTS

| | | | | |
|---|---|---|---|---|
| 2,147,384 A | 2/1939 | Salfisberg | ..... | 206/46 |
| 3,587,839 A | 6/1971 | Brecht et al. | ..... | 206/46 |
| 3,619,344 A | 11/1971 | Wolinski | ..... | 161/161 |

(List continued on next page.)

FOREIGN PATENT DOCUMENTS

| | | | |
|---|---|---|---|
| EP | 196799 | | 10/1986 |
| EP | 0 369 790 | A2 | 5/1990 |
| EP | 0 570 222 | A1 | 5/1992 |
| EP | 0 562 496 | A1 | 9/1993 |
| EP | 0 687 558 | A2 | 12/1995 |
| EP | 0 707 955 | A1 | 4/1996 |
| EP | 673338 | | 5/1996 |
| FR | 1405789 | | 8/1964 |
| GB | 1083578 | * | 9/1964 |
| GB | 2154178 | A | 9/1985 |
| JP | 6015521 | A | 8/1985 |
| JP | 4327936 | A | 11/1992 |
| JP | 6031882 | A | 2/1994 |
| JP | 6039973 | A | 2/1994 |
| JP | 6262673 | A | 9/1994 |
| JP | 7304882 | A | 11/1995 |
| JP | 7314623 | A | 12/1995 |
| JP | 8011927 | A | 1/1996 |
| WO | 95/32095 | | 11/1995 |

OTHER PUBLICATIONS

The Wiley Encyclopedia of Packaging Technology, 2nd Edition A. Brody & K. Marsh John Wiley & Sons Inc New York, Jan. 1997.*

*Primary Examiner*—Keith Hendricks
*Assistant Examiner*—Drew Becker
(74) *Attorney, Agent, or Firm*—Daniel B. Ruble

(57) ABSTRACT

A hermetically sealed package comprises an substantially rigid base(3; 22), preferably a tray, a product (2; 23) to be packaged, which in a preferred embodiment is higher than the tray side walls (5), supported on the tray (3; 22), and a stretch film (8; 15) welded to the substantially rigid base (3; 22) along a sealing line so as to form a hermetically sealed enclosure for the product.

In a method and a machine for manufacturing a hermetically sealed package (1; 101) a stretch film (8; 15) is stretched by means of a stretching frame (17) against a base (3; 22) along a pressure line and is heat welded by means of a sealing frame (18) to the base (3; 22) along a sealing line so as to form a hermetically sealed enclosure for a product (2; 23). (FIG. 4)

21 Claims, 7 Drawing Sheets

U.S. PATENT DOCUMENTS

| | | | | | |
|---|---|---|---|---|---|
| T896,016 | I4 | * | 3/1972 | Harris | 99/171 |
| 3,748,218 | A | | 7/1973 | Newman, Jr. et al. | 161/253 |
| 3,793,135 | A | | 2/1974 | Monia | 161/165 |
| 3,813,846 | A | | 6/1974 | Doering, Jr. | 53/39 |
| 3,997,677 | A | | 12/1976 | Hirsch et al. | 426/113 |
| 4,055,672 | A | | 10/1977 | Hirsch et al. | 426/127 |
| 4,076,570 | A | | 2/1978 | Medley et al. | 156/244 |
| 4,111,349 | A | | 9/1978 | Buckler et al. | 229/3.5 |
| 4,120,984 | A | | 10/1978 | Richardson et al. | 426/412 |
| 4,332,858 | A | | 6/1982 | Saitoh et al. | 428/412 |
| 4,475,653 | A | | 10/1984 | Ullman | 206/497 |
| 4,558,099 | A | | 12/1985 | Kishida et al. | 525/301 |
| 4,575,990 | A | * | 3/1986 | Von Bismarck | 53/434 |
| 4,609,101 | A | | 9/1986 | Ullman | 206/45.33 |
| 4,611,456 | A | | 9/1986 | Gillio-tos et al. | 53/422 |
| 4,659,785 | A | | 4/1987 | Nagano et al. | 525/324 |
| 4,756,421 | A | | 7/1988 | Meek | 206/524.2 |
| 4,796,405 | A | | 1/1989 | Owen et al. | 53/222 |
| 4,832,775 | A | | 5/1989 | Park et al. | 156/272.6 |
| 4,833,862 | A | | 5/1989 | Bortolani et al. | 53/427 |
| 4,847,148 | A | | 7/1989 | Schirmer | 428/332 |
| 4,925,685 | A | | 5/1990 | Sahi | 426/123 |
| 5,226,531 | A | | 7/1993 | Garwood | 206/213.1 |
| 5,259,170 | A | * | 11/1993 | Tolson | 53/441 |
| 5,345,069 | A | | 9/1994 | Grindrod | 219/730 |
| 5,460,861 | A | | 10/1995 | Vicik et al. | 428/34.9 |
| 5,528,881 | A | * | 6/1996 | Cappi et al. | 53/441 |

* cited by examiner

HERMETICALLY SEALED PACKAGE, AND METHOD AND MACHINE FOR MANUFACTURING IT

The present invention relates to the packaging of consumer goods (food and non food products) in plastic containers.

In particular the present invention relates to improved package constructions comprising a base over which the product to be packaged is placed and a thermoplastic cover film which extends over the product and is welded to the base.

A substantial number of products including foodstuffs, such as cheese, meat, processed meat, poultry, fruit, vegetable, fish, pizza, etc., are currently sold in packages consisting of a base, such as a flat support or preferably a tray, on which the product to be packaged is placed, which is then overwrapped with a stretch film, such as, typically, stretch PVC (polyvinyl chloride) and stretch polyolefin films.

This packages are particularly useful when either a flat support is used as the base or when the base has a tray-like configuration and the product to be packaged is higher than the tray side-walls.

A stretch film is by definition a thermoplastic film that when applied under tension around a product elongates and conforms to the shape of the product to be packaged. Stretch overwrapping is generally carried out using either a horizontal stretch wrapper or an elevator-type stretch wrapper.

In the horizontal stretch wrapper the film is pre-stretched and applied over the product while kept under tension by a suitable grip system. The film is then folded longitudinally around the base supporting the product and sealed longitudinally below said base by means of a center-sealer. The film tubing is then transversally severed and the front and rear flaps thus obtained are folded and welded against the tubing surface by passing the package on a heated belt.

In the elevator-type stretch wrapper, the film is kept tensioned and stretched by raising the product placed on a suitable base against the film. Then the film is folded, both transversely and longitudinally, around the base supporting the product and bunch-sealed against the lower surface of said base by passing the package on a heated belt.

Depending on the type of film employed, passing on a heated belt may be insufficient to close the package by tack welding. In such a case, a pressure-assisted welding step is necessary, wherein a driven overhead pressure roller operates in conjunction with the heated belt.

In both cases, however, the welding that is obtained does not always provide for a hermetically sealed package. As a consequence thereof, purge or in general liquids that exude from the packaged product may leak from the package and contaminate the outside of the same package and/or of the other packages that are stored close to it. Furthermore the presence of a liquid in the tack welding area decreases the strength of the tack welding and the overwrapping film can easily unwrap or anyway the package becomes loose.

PVC is the film most commonly used in stretch overwrapping because it has, in addition to a remarkable elongation, also very good elastic properties, i.e. a good elastic recovery and a very low permanent deformation.

Alternatively, stretch polyolefin films are commonly employed such as those described for instance in EP-A-687,558, Japanese patent application publication no. 262673/1994 (Derwent Accession Number 94-337840), Japanese patent application publication no. 39973/1994 (Derwent Accession Number 94-103866), Japanese patent application publication no. 31882/1994 (Derwent Accession Number 94-086225), Japanese patent application publication no. 155210/1985 (Derwent Accession Number 85-239384), or Japanese patent application publication no. 327936/1992 (Derwent Accession Number 93-002817).

These stretch films may be manufactured by cast extrusion or co-extrusion, using either a flat or a circular film die that allows to shape the polymer melt into a thin film or tube; by heat or glue lamination of two or more cast films obtained as above; or by coating or extrusion coating of a cast film with one or more polymer layers. Alternatively, and preferably, these stretch films are manufactured by the blown film (or hot blown film) process wherein a mono- or multi-layer tube is formed and then, while it is still molten, is blown up like a bubble to generate a large diameter tube from a relatively small circular die.

Said stretch films, besides having remarkable elongation and preferably good elastic properties, may also be heat-shrinkable, i.e. they shrink when heated to a temperature that is above the, Vicat softening temperature of the film polymers but below their melting temperature. Said heat shrink feature is provided to the stretch films, by the process for their manufacture. Said process may involve extruding or co-extruding or extrusion-coating a so-called primary tube or sheet, that is quickly quenched, reheated to a suitable orientation temperature and oriented either mono-axially or bi-axially (trapped bubble process or tenter frame process). Or, as the so-called double bubble method described in EP-A-410,792, it may involve extruding or co-extruding the molten polymer to a hot blown film, heating the obtained film to a temperature above its orientation temperature and reinflating it by a blown bubble process. When the stretch film obtained by one of these methods is heated to a temperature that approximates the orientation temperature, it will shrink tending to return to its original dimension before orientation.

Examples of suitable heat-shrinkable stretch polyolefin films are for instance described in EP-A-286,430, EP-A-369,790, GB-A-2,154,178, EP-A-562,496, U.S. Pat. No. 5,460,861, etc.

Actually, in packaging, the stretch films, either PVC or the stretch polyolefin films, are used in the same way to overwrap the product placed on the flat support or in the tray, as indicated above.

When a heat-shrinkable stretch film is employed, a heat treatment following the bunch-sealing step improves the package appearance by tightly conforming the film to the packaged item. Besides the disadvantage of the poor hermeticity of the stretch overwrapped conventional packages, the cost of getting a package by stretch overwrapping, particularly when expensive polyolefin stretch films are employed, may sometimes be unacceptable at industrial level. A large surface of film is in fact needed to get

- the overwrap of the base and the product placed thereupon, and
- the overlapping between the edges to be welded together below the base itself.

As a consequence of the large surface of film required, an additional disadvantage of this packaging method resides in the large amount of plastic waste that is generated and that eventually needs to be disposed of.

Defensive Publication US-T-896 016 discloses a sealed package comprising a tray containing a foodstuff and a polymeric film attached to an outwardly extending flange of said tray by means of a heat sealed adhesive wherein the polymeric film has a tab portion extending beyond at least a portion of the perimeter of the flange to provide easy opening of the package by pulling on the tab.

Said polymeric film has a thickness of about 1 to 10 mils (25,4 to 254 μm) and is not stretched over the foodstuff.

As known in the art, a package wherein a film is not stretched over the foodstuff results in a slack, unattractive package which becomes worse upon handling or upon storage under low temperature conditions.

Further drawbacks of said package are inherent in the manufacturing method requiring burdensome and expensive steps of smearing said heat-sealed adhesive on the tray flange, and of disposing of a substantial ring portion of film extending beyond the perimeter of the flange to provide material for cutting a tab therein.

FIG. 6 of U.S. Pat. No. 3,587,839 discloses a package consisting of a relatively rigid tray containing a packaged product wherein said tray is closed between an upper stretched elastic film and a lower heat shrunk film. This package involves a large waste of plastic material (i.e. the lower film) compared to a package where the upper film is attached to the tray rather than to an additional lower film.

In turn, the packaging method disclosed by U.S. Pat. No. 3,587,839 comprises the steps of placing a heat shrinkable film on a platen, placing a product or a relatively rigid tray containing the product to be packaged on said heat shrinkable film, placing a stretchable elastic film on said product or on said relatively rigid tray containing the product to be packaged, moving downward a film holding device to hold both films against the platen along a line around the periphery of said product, or of said relatively rigid tray containing the product to be packaged, spaced outwardly at a predetermined distance therefrom and from the sealing head so that the tensioning of said upper film occasioned by the subsequent lowering of said sealing head may be controlled and uniform, lowering said sealing head while forcing said upper film into contact with said lower film along a line around and adjacent the periphery of said product or of said relatively rigid tray containing the product to be packaged, energizing the electrical resistance of said sealing head to heat both films sufficiently to form a welded seal and to severe them along a continuous line around and adjacent the periphery of said product or of said relatively rigid tray containing the product to be packaged, transporting the thus obtained package to a suitable station to effect an appreciable shrinkage of said lower heat shrinkable film.

In said method the sealing head has the double task of tensioning the upper film and of heating both films sufficiently to form a welded seal and to severe them. Thus, it is required sufficient time to allow said sealing head to become cold before performing the next tensioning a and sealing step otherwise the hot head pierces the upper film while tensioning it. The packaging speed is thereby substantially slowed down.

U.S. Pat. No. 2,147,384 claims a package comprising a relatively stiff opaque backing sheet of material capable of receiving printing impressions on the surface threreof, and a transparent facing membrane of thermoplastic elastic material stretched over and attached to the face of said backing sheet along the edge portions of said sheet and a membrane so as to provide a commodity receiving space between said sheet and membrane within the connected edges thereof, the edge portions of said backing sheet being corrugated and the edge portions of said transparent membrane being fused into the corrugations of said backing sheet. The backing sheet is said to be preferably composed of a cellulose material, preferably coated with casein. In contrast, no information at all are given about the composition of said transparent elastic rubber membrane and the elastic modulus thereof.

Even the packaging method and machine applied for manufacturing said package are not enabled by such document.

It is an object of the present invention to provide a hermetically sealed package for a product supported on a substantially rigid base as well as a method and a machine for manufacturing said package in a quick way.

It is another object of this invention to provide a hermetically sealed package for a product supported on a substantially rigid base as well as a method and a machine for manufacturing said package using less plastic material than necessary according to the prior art.

Preferably, the product to be packaged has a particularly high profile and is placed in a substantially rigid tray.

SUMMARY OF THE INVENTION

A first object of the present invention is to provide a hermetically sealed package comprising:

i) a substantially rigid base, ii) a product to be packaged supported on said substantially rigid base, iii) a stretch thermoplastic film extending over the product and welded, all around the product, to said substantially rigid base, iv) said stretched thermoplastic film being heat welded to said substantially rigid base along a sealing line so as to form a hermetically sealed enclosure for the product.

In a preferred embodiment of the present invention, said substantially rigid base is a tray with a hollow or recessed center portion, upwardly extending side walls and a peripheral rim provided with a continuous flange and said stretched thermoplastic film extends over the product and is heat welded all around the tray along said sealing line on said continuous flange.

In an even more preferred embodiment of the present invention, the product to be packaged is higher than the tray side walls.

A second object of the present invention is to provide a method for manufacturing a hermetically sealed package for a product comprising:

a) providing a substantially rigid base, b) placing said product to be packaged on said substantially rigid base, c) stretching a thermoplastic stretch film all around said product, d) welding said thermoplastic stretched film to said substantially rigid base all around the product, e) cutting at least some of the stretched film extending beyond the outer perimeter of said substantially rigid base, f) said stretching being performed by stretching and pressing said film against said substantially rigid base along a pressure line, and g) said welding of said film to said substantially rigid base being performed by heating along a sealing line so as to form a hermetically sealed enclosure for the product.

In the package and in the method of this invention, preferably the stretch film is stretched in at least one direction by at least 10%, preferably by at least 15%, and even more preferably by at least 20%. Typically, the stretch film is stretched in both transverse and longitudinal directions. In such a case the stretch film may be stretched to a different degree in one direction compared to the other.

Preferably, when a heat-shrinkable stretch film is employed, said method further comprises heating said package thereby causing the heat-shrinkable stretch film to shrink.

In a preferred embodiment of the method according to the present invention the substantially rigid base is a tray with a hollow or recessed center portion, upwardly extending side walls and a peripheral rim provided with a continuous flange and said stretched thermoplastic film extends over the product and is heat welded all around the tray along said sealing line on said continuous flange.

In a more preferred embodiment of the method according to the present invention, the product which is placed on the upper surface of the tray center portion is higher than the tray side walls.

In an even more preferred embodiment, the product be packaged is fresh poultry and the method of packaging refers to poultry packaging.

A third object of the present invention is to provide a packaging machine for manufacturing a hermetically sealed package, said packaging machine comprising:

A) means for feeding a thermoplastic stretch film,

B) means for advancing said film over a substantially rigid base bearing a product to be packaged,;

C) means for stretching said film all around the product;

D) means for welding said stretched film to said substantially rigid base all around the product; and E) means for cutting at least some of the stretched film extending beyond the outer perimeter of said substantially rigid base, wherein F) said means for stretching comprises a first frame capable of stretching and pressing said film against said substantially rigid base along a pressure line, and G) said means for welding comprises a second frame capable of heat welding said stretched film to said substantially rigid base along a sealing line so as to form a hermetically sealed enclosure for said product.

As it will be apparent, the present invention overcomes the drawbacks of the prior art in that the hermetically sealed package is manufactured by applying a stretch pressure on the film by means of the first stretching frame acting along the pressure line and by separately heat welding the film by means of a second welding frame acting along the sealing line. Thus, it is avoided any piercing of the film thereby improving the quality of the finished packages and the manufacturing speed is also improved.

Moreover, the waste of plastic material is reduced to a minimum.

The equipment shown in the Figures can suitably be employed for carrying out the first steps in the package forming sequence of the method according to the present invention.

Figure 1:
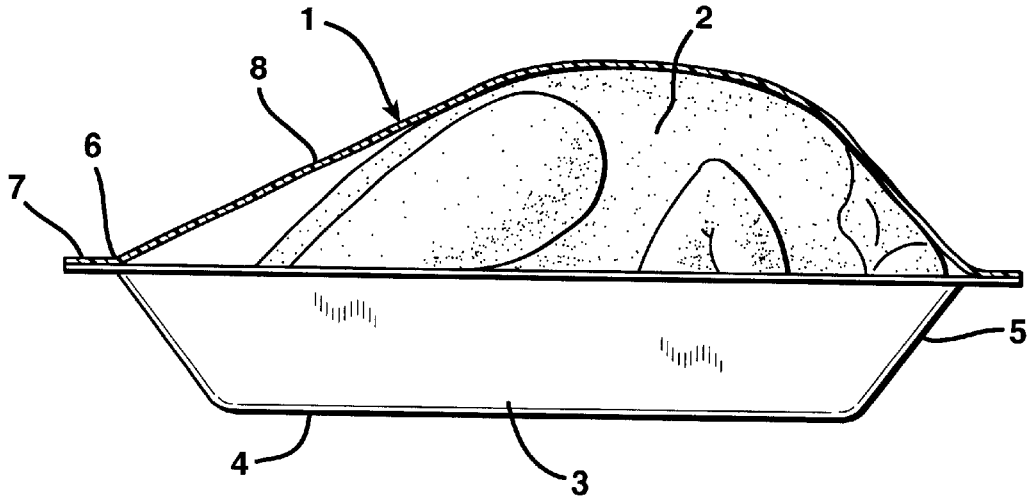
FIG. 1 shows a schematic side view of a hermetically sealed package according to the present invention, having a product therein. It refers to the preferred embodiment where the base has a tray-like configuration and the packaged product is higher than the tray side walls.
Figure 3B:
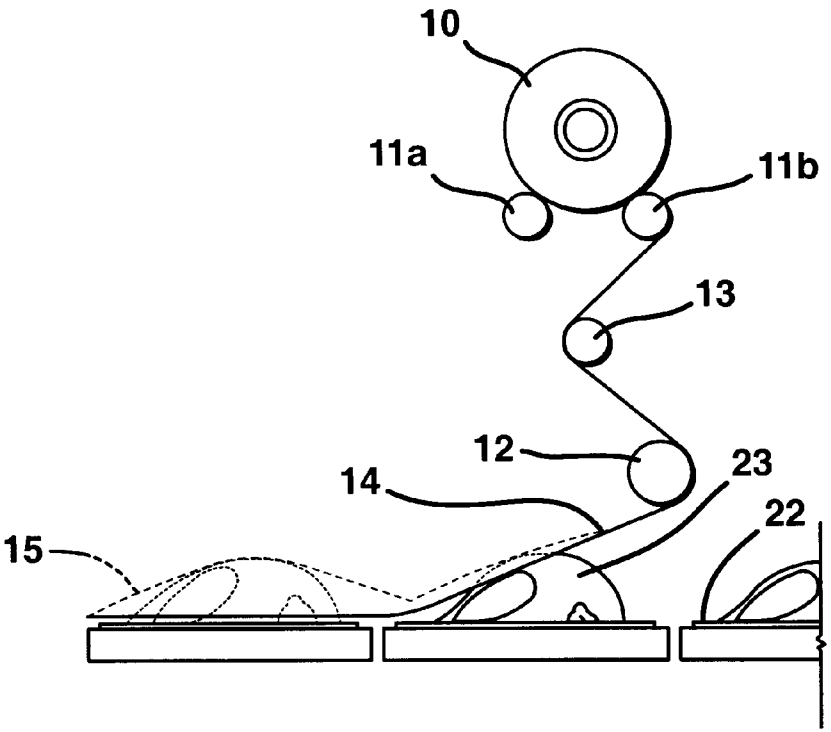
FIG. 3*b* shows a schematic side view of the equipment of the packaging machine of FIG. 3*a*.
Figure 3A:
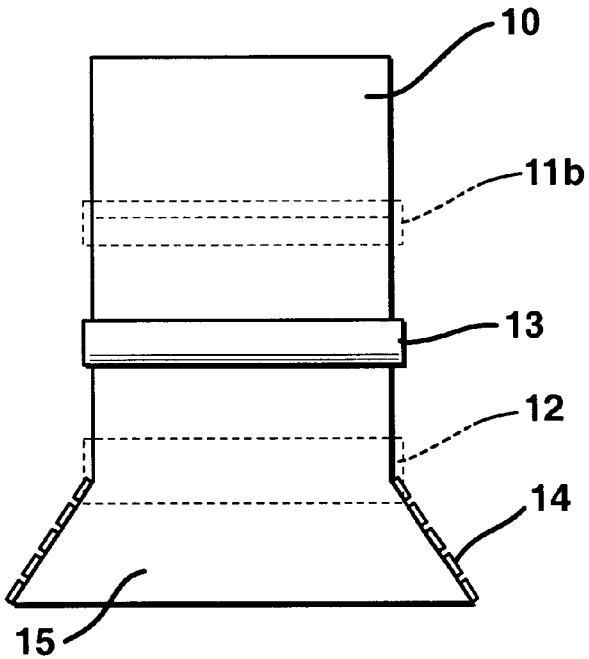
FIG. 3*a* shows a schematic front view of the equipment for treading-up and of the equipment for stretching the film and lowering it close to the base on which the product to be packaged is placed, in the packaging machine of the present invention.
Figure 3C:
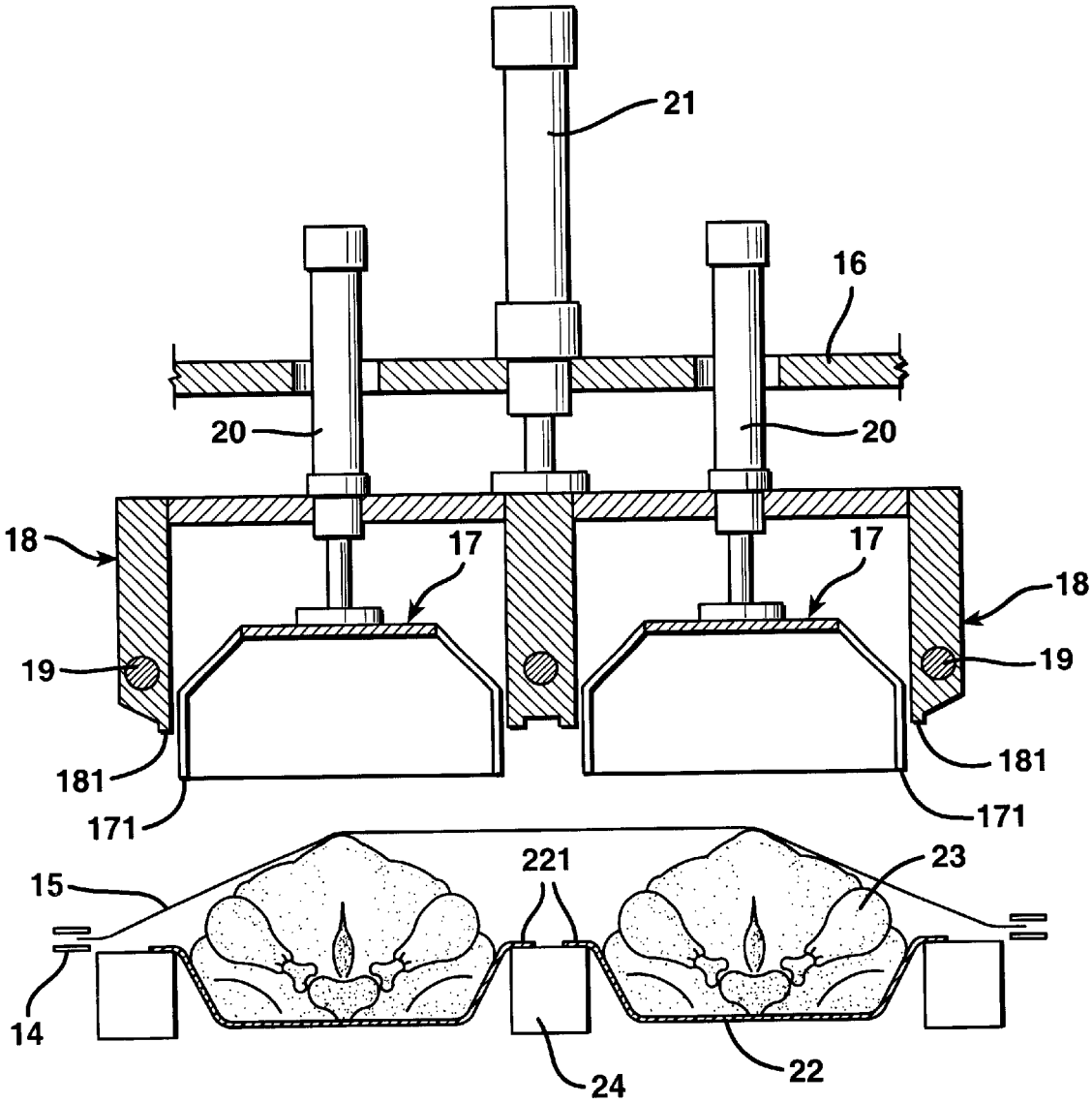

FIG. 3*c* is a schematic cross-sectional view of the sealing station in the packaging machine of FIG. 1 where a first equipment for stretching the film all around the product and a second equipment for sealing the stretched film to the substantially rigid base are shown. The equipment shown in this Figure refers to a preferred embodiment where the substantially rigid base is a tray and the packaged product is higher than the tray side walls. It can suitably be employed to complete the package forming sequence of the method according to the present invention.

Figure 4:
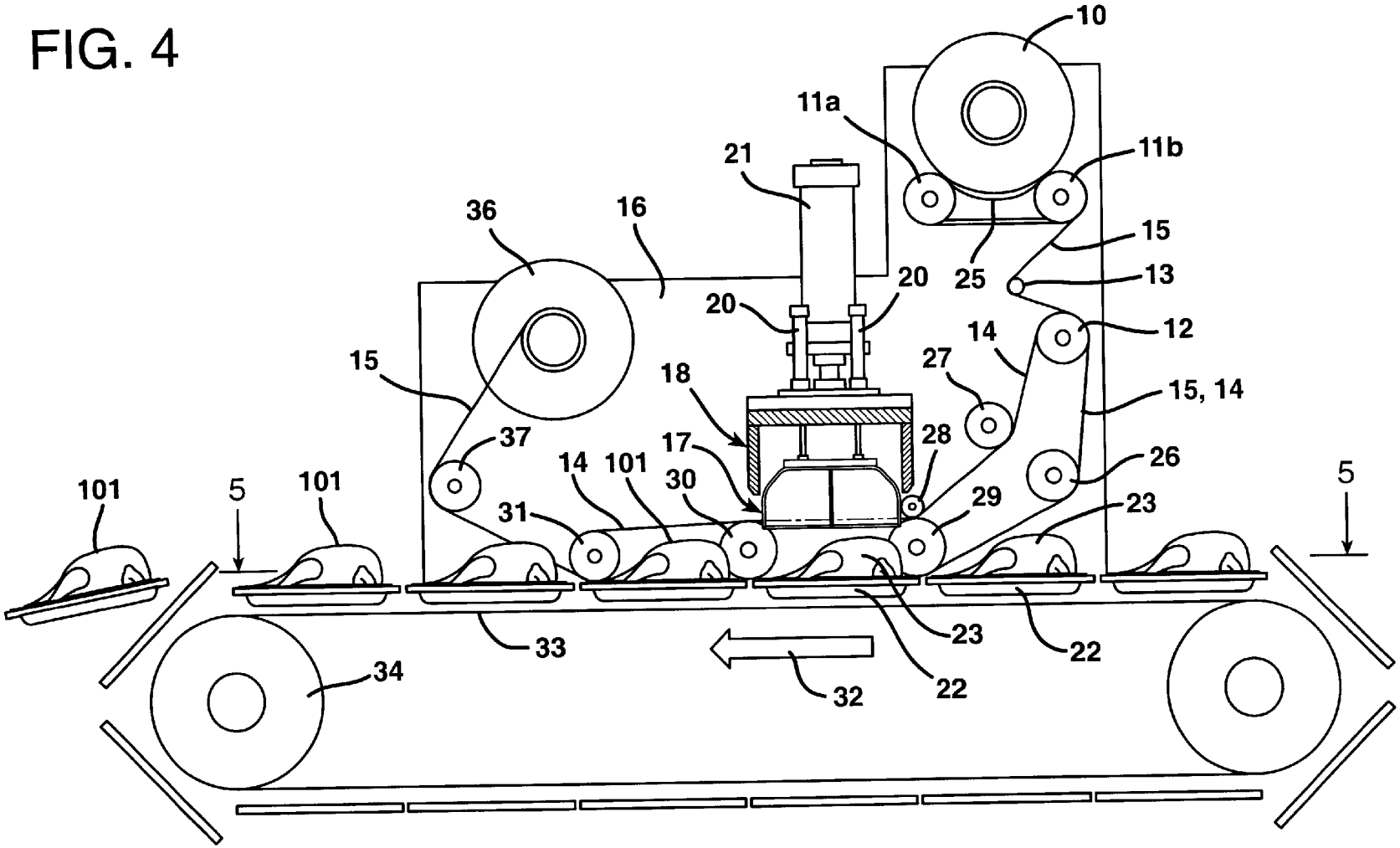

FIG. 4 is a schematic enlarged side view, partially in cross-section, of the overall packaging machine according to the invention, partially shown in FIGS. 3*a*, 3*b* and 3*c*.

Figure 5:
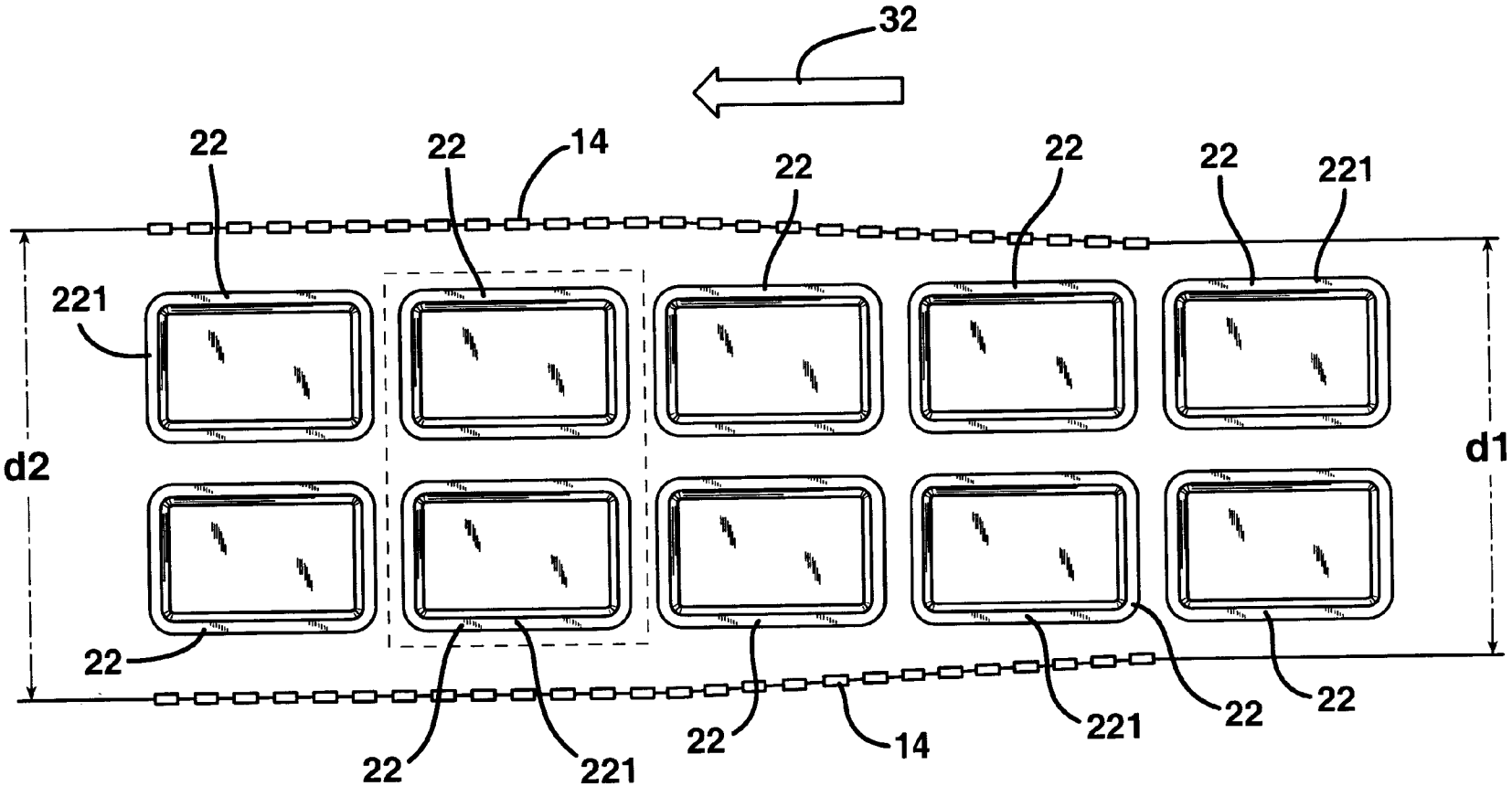

FIG. 5 is a partial cross-sectional view according to the plane V—V of FIG. 4.

Figure 6:
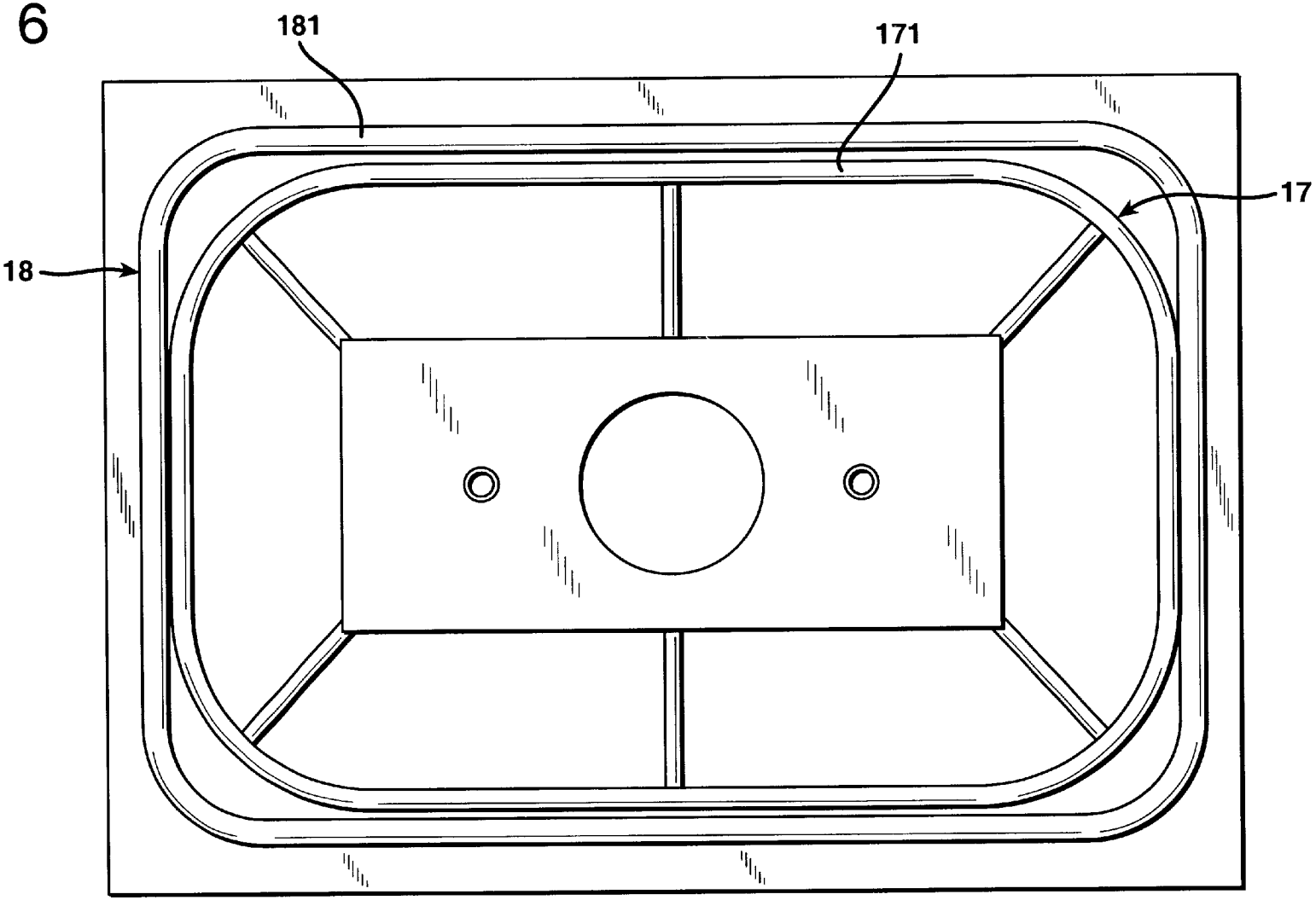

FIG. 6 is a bottom view of a first stretching frame and of a second welding frame of the packaging machine of FIG. 4.

Figure 7:
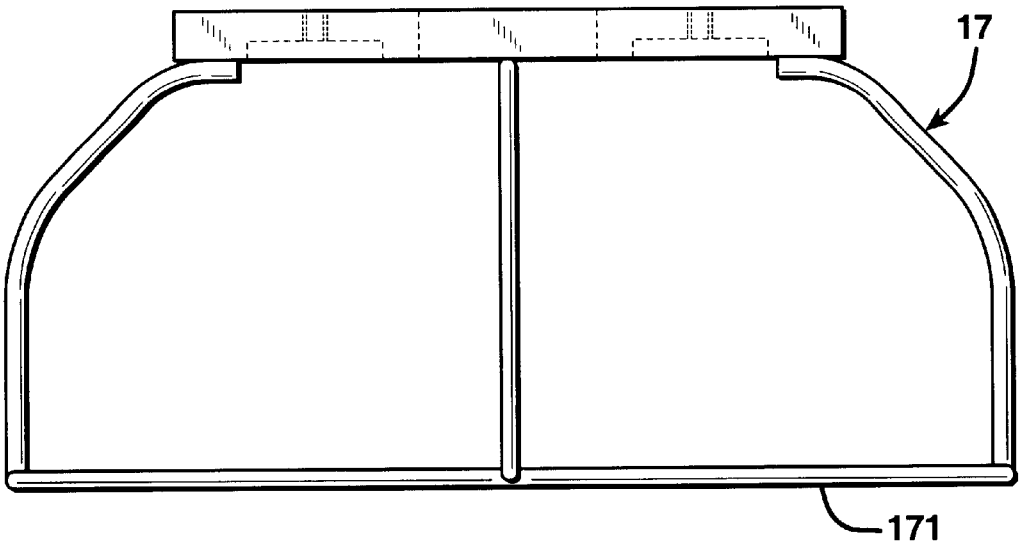
Figure 8:
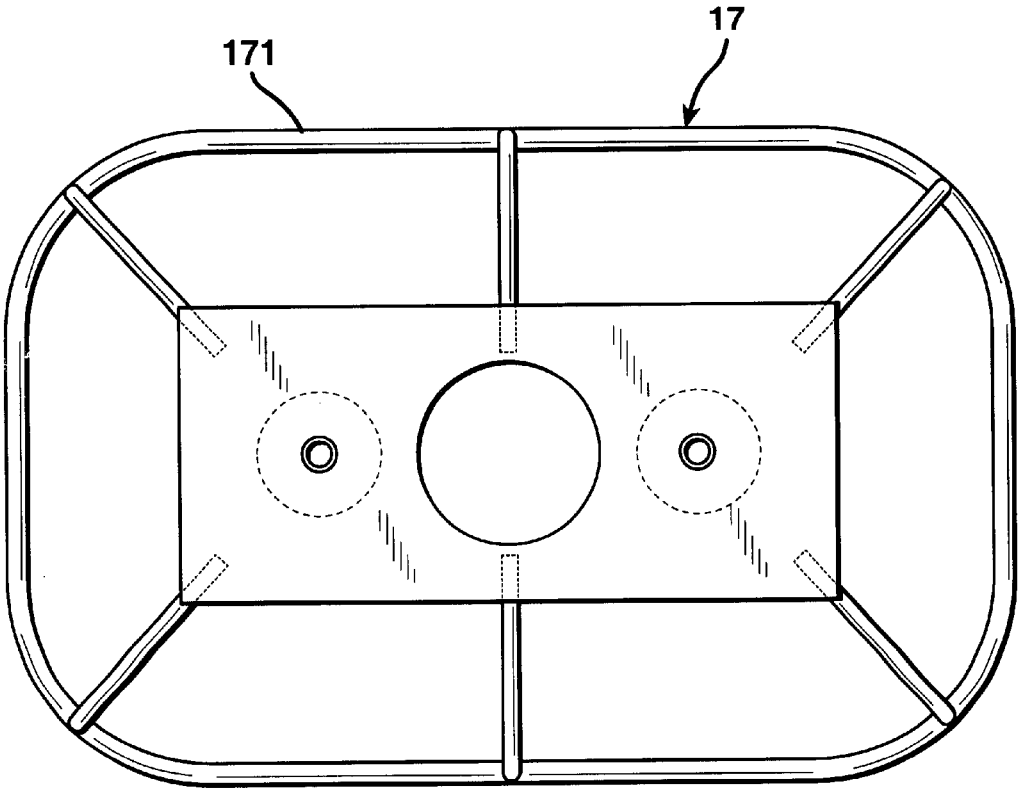

FIGS. 7 and 8 are a side view and a top view, respectively, of the stretching frame of FIG. 6.

DEFINITIONS

As used herein the phrase "over the product" refers to the position of a package component which is over the product when the product or the tray containing it is in an upright position.

As used herein the term "liner" refers to a film, laminate, web, or coating used to line or cover either the upper or lower surface of the base, corresponding, in case of a tray, to the interior or exterior surface thereof. If on the upper interior surface, the liner will typically be in direct contact with the product. "Interior surface" herein is the surface which forms or defines the space into which the product is placed.

As used herein "perimeter" refers to the outer edge, when viewed in plan view, of the relevant element, e.g. substantially rigid base, tray, liner or cover stretch film.

As used herein in connection with a multilayer film or sheet, the phrase "outer layer" refers to any layer having less than two of its principal surfaces directly adhered to another layer of the structure; the phrases "intermediate layer" or "inner layer" refer to any layer having both of its principal surfaces directly adhered to another layer of the structure; the term "welding layer" refers to the outer layer that will be involved in welding of the stretch film to the substantially rigid base.

As used herein, the phrases "heat-sealable layer" and "heat-sealing layer" refer to the welding layers of the stretch film and of the base or base liner (tray or tray liner in the preferred embodiment) that are directly adhered one to another, by heating them to at least their respective seal initiation temperatures, in the welding step.

The heating can be performed by any one or more of a wide variety of manners, such as heated bar(s), hot wires, hot air, infrared radiation, ultrasonic radiation, radio or high frequency radiation, etc., as appropriate.

"Directly adhered", as used above in connection with the welding layers, is defined herein as the contact between said two layers, one to the other, without an adhesive, glue or any other layer in-between. As used herein the term "stretch film" refers to a film capable of being stretched at room temperature (cold stretched) under the conditions of ASTM D-882 (Method A) by at least 150% of its original length without breaking, by applying a stretching force not higher than 2 kg/cm.

As used herein the term "heat-shrinkable" is intended to refer to a film that shows at least 5% of free shrink, at least in one direction, when heated at 90° C. in accordance with ASTM D-2732.

As used herein, the term "polyolefin" refers to any polymerised olefin, which can be linear, branched, cyclic, aliphatic, aromatic, substituted, or unsubstituted. More specifically, included in the term polyolefin are homopolymers of olefin, copolymers of olefin, copolymers of an olefin and a non-olefinic comonomer copolymerizable with the olefin, such as vinyl monomers, modified polymers thereof, and the like. Included are homogeneous and heterogeneous polymers. Specific examples include polyethylene homopolymer, polypropylene homopolymer, polybutene, ethylene-α-olefin copolymer, propylene-α-olefin copolymer, butene-α-olefin copolymer, ethylene-vinyl acetate copolymer, ethylene-ethyl acrylate copolymer, ethylene-butyl acrylate copolymer, ethylene-methyl acrylate copolymer, ethylene-acrylic acid copolymer, ethylene-methacrylic acid copolymer, modified polyolefin resin, ionomer resin, polymethylpentene, etc.

As used herein, the phrase "heterogeneous polymer" refers to polymerisation reaction products of relatively wide variation in molecular weight and relatively wide variation in composition distribution.

As used herein, the phrase "homogeneous polymer" refers to polymerisation reaction products of relatively narrow molecular weight distribution and relatively narrow composition distribution.

As used herein, the phrase "ethylene-α-olefin copolymer," is inclusive of a diverse group of polyethylene copolymers. More specifically, this phrase encompasses such heterogeneous materials as linear low density polyethylene (LLDPE), very low and ultra low density polyethylene (VLDPE and ULDPE), as well as homogeneous polymers such as metallocene-catalysed EXACT™ linear homogeneous ethylene-α-olefin copolymer resins obtainable from the Exxon Chemical Company, and TAFMER™ linear homogeneous ethylene-α-olefin copolymer resins obtainable from the Mitsui Petrochemical Corporation. Other ethylene-α-olefin copolymers, such as long chain branched homogeneous ethylene-α-olefin copolymers available from The Dow Chemical Company, known as AFFINITY™ resins, are also included as inanother type of homogeneous ethylene-α-olefin copolymer.

DETAILED DESCRIPTION OF THE INVENTION

Figure 2:
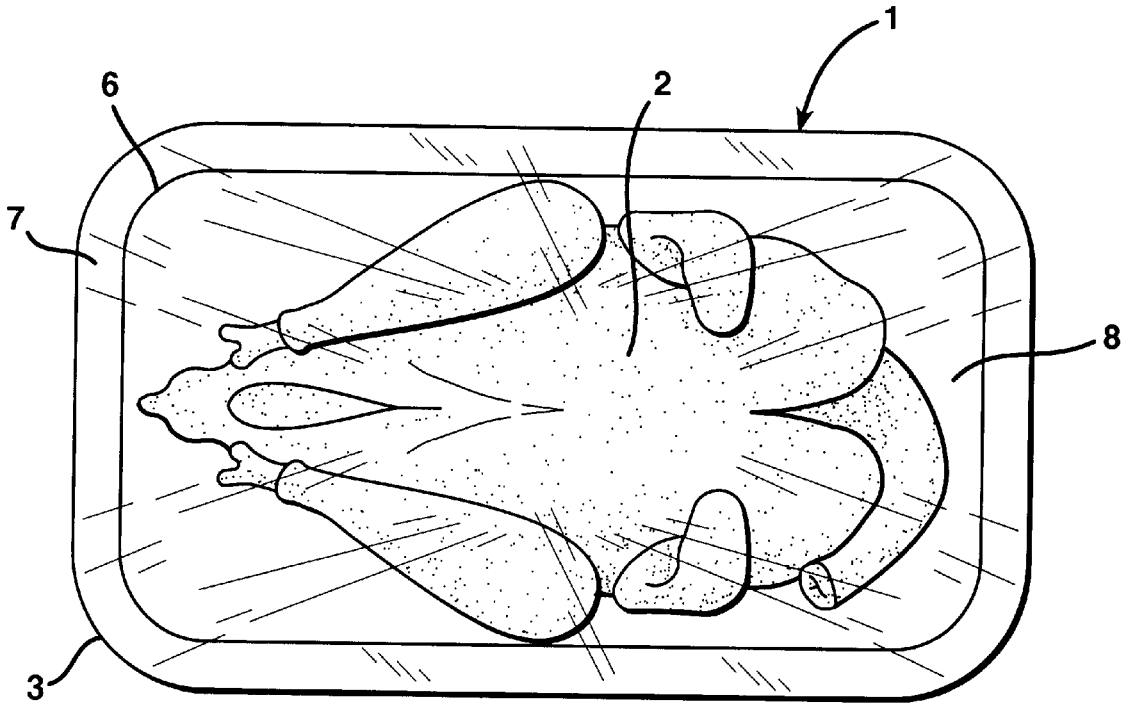
FIG. 2 shows a schematic plan view of the package of FIG. 1 where the base is a tray of conventional rectangular shape with round comers.

FIGS. 1 and 2 show a package 1 according to the present invention having a product 2 on a substantially rigid base 3 having a tray configuration. Said tray 3 has a bottom surface 4 whence walls 5 extend, typically diverging on the opposite side to the bottom, to a peripheral rim 6 with a flange 7. A stretched film 8 encloses product 2 on tray 3 by welding to the tray interior surface at flange 7.

FIG. 1 refers to the most preferred embodiment where a product higher than the tray side walls is packaged.

In FIGS. 3*a* and 3*b*, 10 is a film feed roll, 11*a* and 11*b* are film roll supports, 12 is a pinching roll, 13 is an idle roll, and 14 is the chain of grips clamping a film 15.

In FIG. 3*c*, that also refers to the preferred embodiment where the substantially rigid base has a tray-like configuration and the packaged product is higher than the tray side walls, 16 is a two-lane machine frame bearing two coupled film stretching frames 17 and two coupled sealing frames 18 with heating elements 19. The stretching frames are raised and lowered by means of pneumatic cylinders 20 and the sealing frames are actuated by pneumatic cylinder 21. The trays are indicated with 22, 23 are the products supported on the trays 22, 24 is the tray support frame, while 15 is the stretched film and 14 are the grips that advance the stretched film 15 extending over the products 23 to the sealing station. The tray support frame 24 moves, synchronously with the grips clamping the stretched film, to advance the corresponding loaded trays 22 to the sealing station.

FIG. 4 shows the overall packaging machine comprising the equipment of FIGS. 3*a*, 3*b* and 3*c*.

Feeding roll 10 is driven by an electric motor, not shown, at a prefixed speed for unwinding film 15. While the film is unwound, it is guided by two partially arched belts 25 driven by rolls 11*a* and 11*b* and by the idle roll 13. Film 15 is pulled by grips (not shown in details) supported by two chains 14, as known in the conventional Horizontal Stretch Wrapping machines. Said grips are actuated to clamp the film side edges by pinching roll 12. In turn, chains 14 are driven by pinching roll 12 at a tip speed higher than the tip speed of said feeding roll 10 by a preselected amount, thereby stretching longitudinally said film 15.

Said two grip chains 14 are guided to and from the sealing station by sprocket couples 26, 27, 28, 29, 30 and 31. The sprockets of each couple are set at the sides of said two-lane tray support frame 24 (FIGS. 3*c* and 5). The sprocket couples 12, 26 and 29 have a distance between centers which increases from the sprocket couple 12 to the sprocket couple 29. Accordingly, the distance between said two grip chains 14 increases. In a preferred embodiment, the distance d1 between centers of said sprocket couple 12 is of about 390 mm, while the distance d2 between centers of said sprocket couple 29 is of about 400–405 mm. Thus, said film 15 is advanced longitudinally (arrow 32) and stretched transversally by said grip chains 14 over the trays 22 and the products 23 contained therein.

The tray support frame 24 (FIG. 3*c*) is carried by a chain 33 driven by a sprocket 34.

Said stretching frames 17 and sealing frames 18 of the sealing, station have, in plan cross-section, a shape as that of a tray flange 221 (FIGS. 5, 6). More particularly, each stretching frame 17 has a peripheral rim 171 (FIGS. 3*c*; 7, 8) which substantially overlaps the inner perimeter (e.g. the inner peripheral rim) of the tray flange 221 and presses said film 15 against said tray flange 221 along a first line (i.e. pressure line). In trun, each sealing frame 18 has a peripheral rim 181 which presses said film 15 against said tray flange 221 along a second line (i.e. sealing line) which preferably runs in between said inner and outer flange perimeters.

Thus, said stretching frames 17 bring said film 15 into closed contact with said flange 221 along a first line and then said hot sealing frame 18 enters into closed contact with said film 15 along a separate second line in order to perform the sealing step by heat welding.

Thereby said film 15 is heat welded to each tray 22 containing the product 23, thus obtaining a hermetically sealed packages 101.

The remaining riddled film 15 is released by the grip chains 14 at the outlet of the sealing station where the grips are actuated by the sprockets 31 to open. The remaining film 15 is then wound on a recovering roll 36, while it is guided by an idle roll 37. In the first steps of the packaging process that is carried out by the equipment schematically shown in FIGS. 3*a*, 3*b* and 4, roll 10 is unwound, guided by the film roll supports 11*a* and 11*b* and said film 15 is conveyed to roll 12 where it is pinched. Pinching roll 12, runs at a speed higher than that of roll supports 11*a* and 11*b*, thus allowing the longitudinal stretching of said film 15. In this step the grips lower the clamped film extending it over the product (23) to be packaged loaded on said substantially rigid base 22 as shown in FIG. 3*b*. Meanwhile, said grip chains 14 cause said film to advance while moving away each other to stretch said film transversely.

When a flat-support is used as substantially rigid base, or when, according to a preferred embodiment of the present invention, a substantially rigid base having a tray-like configuration, is employed and a product higher than the tray side walls is packaged, said film 15 undergoes an additional stretching by extending itself over the product to be packaged 23.

Said substantially rigid base supporting the product to be packaged and said stretched film 15 extending over said product, are then advanced to the sealing station, schematically shown in FIGS. 3*c* and 4.

The second steps of the packaging process according to the present invention can suitably be carried out by means of the equipment schematically shown in FIGS. 3*c* and 4. In such an embodiment, stretching of the cover film all around the products 23 is improved by lowering the stretching frames 17 driven by the cylinders 20 so that their peripheral rims 171 come into close contact with both said film 15 and said inner peripheral rims of the tray flanges 221 along said pressure line. Once the stretching frames are in place, the sealing frames 18, heated by the heating elements 19, are lowered by the pneumatic cylinders 21 supported by the machine frame 16 so that their peripheral rims 181 presse said film 15 on said tray flanges 221 along said sealing lines. The sealing frames are kept in the lowered position at the temperature and for the time required to heat welding the stretched film to the tray rims. During this time the sealing frames press the stretch film 15 and the trays 22 against the tray support frame 24.

FIGS. 3*c* and 4 show a two-lane packaging machine. It has also to be understood that the packaging machine of this invention may be designed to comprise a single lane or any other multi-lane without departing from this invention. The choice will depend on the number of the products to be packaged, the machine speed, and the width of the stretch film.

While FIGS. 3*c* and 4 refer to a preferred, embodiment wherein the stretch film is heat-sealed to the tray flange, it has to be understood that the present invention encompasses many suitable sealing frame, capable of joining plastics by ultrasonic waves, by radio or high frequency welding, etc.

Advantageously, the rigid base is formed of a semi-rigid or, preferably, of a rigid thermoplastic material. These terms, when referred to plastics and plastic sheets, are as defined in ASTM D 883.

Suitable substantially rigid bases can be sheets of foamed or unfoamed, extruded or coextruded or injection moulded materials, or sheets of cardboard or corrugated cardboard lined with a thermoplastic mono- or multi-layer film.

When said substantially rigid base has a tray-like configuration, for the purposes of the present application the term "rigid" identifies a tray or container that is self-standing and does not change its shape when an item is placed therein, while the term "semi-rigid" identifies a tray or container that is self-standing and can be slightly deformed by the contained item.

A substantially rigid tray can be obtained by thermoforming a foam polymer sheet, such as for instance foam polystyrene (EPS), foam polypropylene (EPP), foam polyester (EPET), and the like foam polymers. These trays are commonly manufactured by a two-stage process that involves extrusion of the polymer foam sheet followed by curing and thermoforming of the polymer foam sheet by methods well known in the art. These foam trays can be pre-formed or formed in line during the packaging process. If desired, flexible polymeric film sheets can be. adhered thereto to provide for oxygen barrier properties or improved oxygen barrier properties and or improved sealability. Foam trays with a flexible liner are described e.g. in U.S. Pat. No. 3,748,218, U.S. Pat. No. 3,793,135, U.S. Pat. No. 4,055,672, U.S. Pat. No. 4,076,570, U.S. Pat. No. 4,111,349; U.S. Pat. No. 4,332,858, U.S. Pat. No. 4,558,099, U.S. Pat. No. 4,659,785, U.S. Pat. No. 4,832,775, and U.S. Pat. No. 4,847,148. It is also possible, when the liner is used to improve sealability, to adhere it only to the tray flange where the stretch film has to be sealed.

These foam polymer trays can also be obtained by injection moulding of the foaming polymer.

Alternatively a substantially rigid tray to be used in the manufacture of a package according to the present invention can be made by lining a cardboard tray with a mono or multilayer flexible thermoplastic film, as defined above, that can be welded to the cover stretch film.

Still alternatively a substantially rigid tray can be obtained by injection moulding of a polymer melt. If barrier properties or improved barrier properties are desired, the injection moulded tray can be coated with e.g. a PVdC layer, for instance by a spray coating step.

Similarly, a semi-rigid tray may be obtained by thermoforming a mono- or multi-layer thermoplastic sheet. If oxygen barrier properties are desired the sheet will comprise at least one layer of an oxygen barrier material such as PVdC, EVOH, nylon, EVOH and nylon blends, etc. Depending on the thickness of the starting sheet and the degree of deep drawing applied, the obtained tray may be more or less thick and therefore more-or-less substantially rigid. In any case the essential requirement for these trays is that the polymer used for the monolayer sheet or, in case of a multilayer sheet, the polymer or polymer blend used for the outer layer that will be in contact with the product, can be welded to the stretch film. Examples of materials for the mono- or multi-layer sheets that can be thermoformed and used as trays in the package according to the present, invention are e.g. polyolefin, PVC, nylon, polyurethane, PVC/polyolefin, polystyrene/polyolefin, nylon/polyolefin polyester/polyolefin, PVC/PVdC/polyolefin, PS/PVdC/polyolefin and many other materials or combinations of materials which are well known in the art.

In a preferred embodiment of the present invention, the tray is formed of a foam polymer, preferably foam polystyrene, optionally lined with a heat-sealable polyolefin material, foamed polypropylene or foamed polyester. In another preferred embodiment the tray is formed of PVC or of a polymer that can be easily welded to a PVC stretch film.

The above description of suitable or preferred materials and methods of manufacture that in its wording specifically refers to the preferred embodiment of bases having a tray configuration, does clearly apply also to the bases shaped as flat support.

The dimensions of the substantially rigid base are not critical and depend on the size of the product to be packaged. The substantially rigid base should be larger than the product to be packaged leaving an edge of at least 0.5 cm all around the product to allow welding a stretch film to a substantially rigid base to get a hermetically sealed package.

When a substantially rigid base with a tray-like configuration is employed, the dimensions of said tray, and particularly of the tray hollow center portion will depend on the size of the product to be packaged therein. When, according to a preferred embodiment of the invention, a product higher than the tray side walls is packaged, generally the height of the tray side walls will be from about 1/20 to about 19/20 of the height of the product to be packaged.

Also the thickness of the substantially rigid base is not critical for its use in the package and method according to the present invention.

Generally the thickness thereof will depend on the particular type of the substantially rigid base (whether a flat support or a tray-like substantially rigid base, whether obtained by extrusion or by injection moulding, whether made of foamed or unfoamed material, whether mono- or multilayered, etc.) and the application foreseen. Typically such a substantially rigid. base will be of from about 150 $\mu$m to about 5 mm thick, and preferably of from about 200 $\mu$m to about 4 mm thick.

When a substantially rigid base having a tray-like configuration is employed, particularly when the side walls are inclined and not perpendicular with respect to the tray bottom surface, said tray needs to have a flange all around the tray rim where the stretch film is welded to the tray. The presence of such a flange will allow in fact the use of an anvil (the tray support frame indicated as 24 in FIG. 3*c*) to the sealing frame that counterpresses the tray against the film to get a reliable seal.

The size of this flange is generally sufficient to perform a seal at least 2 mm wide all around the tray. When the tray side walls are perpendicular to the tray bottom surface, the tray side wall itself will act as an anvil for the sealing frame.

The choice of the material used for the stretch film or for the welding layer of the stretch film will be dictated by the choice of the material used for the upper surface of the substantially rigid base or of the substantially rigid base liner and by the method used to weld the stretched film to the substantially rigid base.

In particular, the polymers or polymer blends used for the stretch film or its welding layer will be chosen so as to heat-seal themselves to the substantially rigid base or substantially rigid base liner upper surface under the sealing conditions that are applied.

When according to a preferred embodiment of the present invention an EPS substantially rigid base is employed, a stretch film comprising a styrene-based thermoplastic elastomer in the welding layer is preferably employed as the cover film and the film and the substantially rigid base are preferably heat-sealed together by means of a heated framed by pressing them together against a framed anvil.

Styrene-based thermoplastic elastomers that can suitably be employed in the sealing layer of such a stretch film include but are not limited to styrene-butadiene block copolymers, styrene-butadiene-styrene terpolymers, styrene-ethylene butene-styrene block terpolymers, and styrene-isoprene-styrene terpolymers. For use in the sealing layer of the stretch film said thermoplastic elastomers may simply be compounded with the conventional additives, such as lubricants and slip agents, or also blended, if desired, with a suitable polymer compatible therewith.

More particularly it has been found that the styrene-butadiene block copolymer that is sold by BASF under the trade name Styroflex BX 6104 can suitably be employed to manufacture a stretch film that can be heat sealed to an EPS substantially rigid base. Said stretch film may or may not be also heat-shrinkable.

Also suitable for use in connection with polystyrene bases are the films containing $\alpha$-olefin/styrene copolymers described in WO 95/32095. Also suitable are expected to be the films described in Japanese patent application publication 11927/1996 (Derwent Accession Number 96-112039).

Alternatively when the EPS substantially rigid base is lined e.g., with a polyolefin layer such as a polyethylene, an EVA, or a linear polyethylene layer, a polyolefin stretch film is preferably employed. Stretch polyolefin films that can suitably be used in such a case are e.g. those described in the patent literature listed above. Examples of suitable polyolefin stretch films are those sold by Cryovac® under the trade name SSD 310, a 5-layer, 15 $\mu$m thick, symmetrical structure with ethylene-vinyl acetate copolymer skin and core layers and low density linear polyethylenes intermediate layers, or SES 320, a 5-layer, 15 $\mu$m thick, symmetrical structure with a blend of ethylene-vinyl acetate copolymer and low and medium density linear polyethylenes in the skin layers, a core layer of ethylene-vinyl acetate copolymer and low density linear polyethylenes as intermediate layers.

When a polypropylene substantially rigid base, such as an EPP substantially rigid base, is employed, a suitable stretch film that can be used as the cover film is that commercialised by Asahi under the trade name H100H. This film which has a high stretchability appears to be an irradiated 5-layer symmetrical structure with skin layers of ethylene-vinyl acetate copolymer, a core layer of a propylene-butene-ethylene terpolymer and intermediate layers of a blend of ethylene-vinyl acetate copolymer, polypropylene and ethylene-propylene copolymer. An alternative commercial film that can suitably be employed in conjunction with a polypropylene tray is Cryovac® SSD 310.

Stretch films such as those described in Japanese patent application publication 304882/1995 (Derwent Accession Number 96-035951) or in Japanese patent application publication 314623/1995 (Derwent Accession Number 96-054783) are also expected to be suitable for use in conjunction with a polypropylene substantially rigid base.

When a polyester substantially rigid base, such as an EPET substantially rigid base, is employed, suitable stretch films that can be employed as the cover films have a sealing layer of a polyester or copolyester, more preferably of a flexible copolyester.

Preferably the thickness of the stretch film will be less than 50 $\mu$m. Typically, the stretch films to be used in the package and in the method of packaging according to the present invention have a thickness of from about 8 to about 30 $\mu$m and preferably of from about 10 to about 25 $\mu$m.

Preferred stretch films to be used in the method and package according to the present invention are those than can be cold stretched by at least 180% of their original length without breaking, by applying a stretching force not higher than 2 kg/cm.

More preferred stretch films to be used in the method and package according to the present invention are those than can be cold stretched by at least 180% of their original length without breaking, by applying as stretching force not higher than 1.5 kg/cm.

Even more preferred stretch films to be used in the method and package according to the present invention are those than can be cold stretched by at least 180% of their original length without breaking, by applying a stretching force not higher than 1 kg/cm.

Furthermore, preferred stretch films are those coupling a high elongation with a low permanent deformation. Permanent deformation of a film is measured by stretching a sample of the film by 50%, allowing it to relax for 30 seconds and then measuring the percent increase in length of the sample. A film with a low permanent deformation is a film that can recover its original (planar) state after being stretched, such as by the deforming force of a finger that depresses it. A film with a low permanent deformation will more easily maintain its original aesthetically attractive appearance even after handling abuse.

Permanent deformation in the two perpendicular directions, TD and MD, is measured by an Instron tensile instrument on strips of film 12.5 cm long and 2.5 cm wide. The film is stretched by separating the jaws holding the ends of the test specimen at a constant rate until 50% stretch is obtained. Then the jaws are returned to the original position, the film specimen is allowed to relax for 30 seconds, and its length is measured and compared with the original one.

As indicated, preferred stretch films are those than under the above conditions show a permanent deformation in both directions lower than 20%, and even more preferred are those showing a permanent deformation lower than 15%.

The stretch film may also be heat-shrinkable. In the latter case, typically, the stretch film shows a % free shrink at 90° C. of at least 10 in at least one direction. Free shrink is measured:by ASTM Method D-2732 (5 second immersion time).

For most of the applications the stretch films and the substantially rigid bases employed in the package and method according to the present invention do not need to have oxygen barrier properties.

However, when oxygen barrier properties are required, oxygen barrier stretch films should be employed in combination with oxygen barrier bases. An example of oxygen barrier stretch film is Ecowrap BSS film by Okura that uses an ethylene-vinyl alcohol copolymer for its oxygen barrier layer. Suitably plasticised PVdC, e.g. EVA plasticised PVdC, might also be used in the manufacture of oxygen-barrier stretch films.

In the method of packaging according to the present invention, a substantially rigid base is provided, if necessary or desirable, with a thermoplastic film liner adhered by any suitable means to its upper surface or part thereof. A product, e.g. a fresh poultry product, is placed onto said substantially rigid base, or in the recess formed by the tray, when a substantially rigid base with tray-like configuration is employed.

In the preferred embodiment shown in FIGS. 1–4, a substantially rigid base with tray-like configuration is employed and the packaged product is higher than the tray side walls.

A stretch, optionally heat-shrinkable, film is then stretched over the product and welded to the substantially rigid base all around the product, or to the tray flange, when a substantially rigid base with tray-like configuration is employed.

In the embodiment shown in FIGS. 3*a*, 3*b*, 3*c*, and 4 the film is first stretched longitudinally by running the film roll 10 and the pinch roll 12 at a differential speed, then it is stretched transversely e.g. by means of a series or chain of gripping means 14 that move apart while lowering towards the products. When a substantially rigid base is employed which has the shape of a flat support or has a tray-like configuration and a product higher that the tray side walls is packaged, as shown in FIGS. 3*c* and 4, an additional stretching is achieved by lowering the gripping means towards the plane of the supported products as the tensioned film is stretched all around the products.

Once the desired width of the film web is obtained, the gripping means advance the film, extended over the products placed on the bases, to the sealing station by moving along parallel tracks. Synchronously also the bases with the products placed thereon are advanced to the sealing station.

When a substantially rigid base is employed which has the shape of a flat support or has a tray-like configuration and a product higher that the tray side walls is packaged, as shown in FIGS. 3*c* and 4, stretching of the film all around the product is facilitated by means of a stretching frame 17. Said stretching frame is a frame having a perimeter larger than that of the packaged product and smaller than the outer perimeter of the substantially rigid base, and, in case of a substantially rigid base with a tray-like configuration, a perimeter contouring the inner perimeter of the tray. When this stretching frame is lowered, it will better conform the stretch film all around the product both transversely and longitudinally. While heat welding of the stretched film to the substantially rigid base can be achieved, as indicated before, by any conventional means, in a preferred embodiment said heat welding is performed using a heated sealing frame 18. Said sealing frame 18 has the same shape and a perimeter larger, preferably only slightly larger, than that of the stretching frame 17. The sealing frame lowers, once the stretching frame is on place, to seal the stretched film to the substantially rigid base by pressing the film against the substantially rigid base itself.

In the preferred embodiment shown in FIG. 3*c*, said welding is performed by heat-sealing using a heated sealing frame 18 having the same shape and the same perimeter as the tray flange. Sealing is achieved by pressing the stretched film against the tray flange supported by the tray support frame 24. In the embodiment shown in FIG. 3*c*, the sealing frame is heated by means of heating means 19. The sealing temperature is suitably selected depending on the type of material to be sealed together as known in the art. Also the pressure exerted on the seal and the sealing time can be easily set depending on the materials to be sealed and the sealing temperature selected.

It is intended that it can be easily conceived to weld the stretch film to the tray rim by any other conventional heat-sealing means, as indicated above. As an example when materials are employed that can be welded by RF, instead of the heating elements (19) on the sealing frame, both the sealing frame and the tray support frame (24) may be connected to a RF generator as known in the art to RF seal the stretch film to the substantially rigid base.

The hermetically sealed packages 101 are then separated one from the other by means of a knife, serrated blade, or equivalent means which is brought down near the outer edge of the substantially rigid base, and, in case of a tray-like substantially rigid base, near the outer edge of the tray flange. Some or all of the excess film material extending beyond the edge of the substantially rigid base or tray flange is then cut away.

If a heated cutting means and a heat-shrinkable stretch film are used, the heat of the heated knife causes the remaining heat-shrinkable stretch film beyond the seal to shrink-back, close to the seal region, i.e. close to the tray rim or in the flange area-of the tray, when a ray-like substantially rigid base is employed, forming a bead along the flange.

When a heat-shrinkable stretch film is employed, the package may be optionally submitted to a separate heat treatment in order to shrink the stretched film more tightly all around the packaged product.

As indicated above, for most of the applications there is no requirement for the use of oxygen barrier packaging material and the packaging process is carried out under atmospheric pressure. In some cases however it may be convenient, in order to improve the shelf life of the packaged product, to carry out the packaging process under a suitably modified atmosphere obtained e.g. by flushing the modified atmosphere while stretching lowering the tensioned film against the supported product or by carrying out this step in a closed sealing station.

While FIGS. 3*c* and 4, as well as the preceding description, generally relate to the welding of the stretched film to the upper surface of the tray flange, it would also be possible, alternatively, to stretch the film over and around the outer edge of said flange, fold it over the lower surface of said flange and weld it thereto. It would thus be possible to get a hermetically sealed package and still a saving in the amount of plastic material, even if not as substantial as that obtained by welding the stretched film to the upper surface of the tray flange as in the preferred embodiment illustrated in FIGS. 3*c* and 4.

In such a case the packaging machine should also comprise means for folding the stretched film over the outer edge of the tray flange. Suitable modifications of the packaging machine described above can be easily devised by the person skilled in the art to carry out the additional folding step and the welding of the stretched-film-against the lower surface of the tray flange.

EXAMPLE 1

Polystyrene foamed trays (23 cm×14.5 cm) with inclined walls about 5 cm high and a tray rim with a flange of about 0.8 cm all around the tray perimeter, are loaded with a fresh poultry product extending about 5 cm above the tray walls. These trays are carried by a conveyor, at a predetermined linear rate, into a two-lane sealing station. The cover film is a mono-layer stretch film of Styroflex BX 6104 by BASF, about 15 $\mu$m thick and 38 cm wide, with elongation of 150% at 0.35 kg/cm stress and a permanent deformation in both directions less than 20%. Said cover film is stretched longitudinally by 30% and transversely by 10% by the stretching process described above. An additional percent stretching would result from the extending of the film all around the products. The stretching frames 17, wherein each frame has a perimeter contouring the inner perimeter of the corresponding tray, are lowered to conform the stretch film all around the products both transversely and longitudinally and once the stretching frames are in place, the heated sealing frames 18 press the stretch film against the tray flanges supported by the tray support frame. The stretching and the sealing frames are then raised and the sealed packages are advanced. A blade contouring the tray flanges finally removes the excess of stretch film beyond the tray outer edges.

In the sealing step, the sealing pressure is set at 2 kg/cm$^2$ and the sealing time at 0.5 sec, while the sealing temperature has been varied. Under these sealing conditions it has been found that reliable seals can be obtained in the range of temperatures comprised between 80 and 200° C., while the preferred sealing temperature was about 120° C.

EXAMPLE 2

Polystyrene foam trays as in Example 1 are lined with a flexible film having the following structure : a sealant layer (i.e. the layer to be sealed to the stretch film cover in the tray flange area) of ethylene-vinyl acetate copolymer (EVA); a tie layer of an anhydride. modified ethylene-vinyl acetate copolymer; and a layer of ethylene-methyl acrylate copolymer for bonding to the foamed polystyrene tray.

The products are placed in the trays and Cryovac® SSD-310 stretch film (a stretch heat-shrinkable 15 $\mu$m thick film having the following structure: EVA LLDPE EVA LLDPE EVA with 150% elongation at 1.2 kg/cm stress and less than 15% permanent deformation in both directions) is stretched over the products and heat-sealed along the flange at the tray rim. The excess stretch film is cut away by means of a heated cutting blade and a bead is formed along the flange due to the shrink of the excess film beyond the seal.

EXAMPLE 3

Trays of the same size as indicated in Example 1 are obtained by thermoforming a PVC sheet 320 $\mu$m thick. The trays are loaded with fresh poultry product extending above the tray side walls by about 5 cm, as in Example 1 and a stretch PVC film, 15 $\mu$m thick, is stretched over the products and heat-sealed to the tray flange by means of the heated sealing frame under the following conditions: sealing temperature=175° C., sealing pressure=2.0 kg/cm$^2$, and sealing time=3 sec.

Alternatively the stretch PVC film may be sealed to the PVC tray flange by RF under conventional conditions.

In experiments carried out with a product 6-cm higher than the tray side walls, stretching was preferably of from about 33 to about 45% in transverse direction and of from about 25 to about 30% in longitudinal direction; a further increase of the height of the product by 1 cm with respect to the tray side walls resulted in an additional stretching of about 10% in transverse direction and about 5% in longitudinal direction.

COMPARATIVE EXAMPLE 4

The same trays as in Example 1 are loaded with fresh poultry product extending above the tray side wall by about 5 cm, and overwrapped with the same stretch film as in Example 1. The edges of the film are then longitudinally sealed below-the tray and then the rear, and front flaps are folded over the tray edges and sealed to the tubing surface on the bottom of the tray. The packaging machine was a conventional Omori horizontal stretch wrapper.

By comparing the amount, in cm$^2$, of film required for each package, including the unavoidable scrap, it has been found that by the packaging method of the present invention a saving of more than 50% of the stretch film is obtained with respect to the conventional process.

What is claimed is:

1. A hermetically sealed package comprising:

a) a substantially rigid base;

b) a product supported on said substantially rigid base; and c) a thermoplastic stretch film over said product wherein said stretch film:

is capable of cold stretching at room temperature under the conditions of ASTM D-882 (Method A) by at least 150% of its original length without breaking when applying a stretching force of not higher than 2 kg/cm;

is capable of a permanent deformation in length in each of the machine and transverse directions of less than 20%, where the permanent deformation is measured by providing a representative film sample having original dimensions of 12.5 cm long and 2.5 cm wide, stretching the film sample lengthwise at a constant rate until 50% stretch is obtained, releasing the film sample for 30 seconds, subsequently measuring the length of the stretched film sample, and calculating the percent increase in length of the stretched film sample compared to the original film sample;

is pre-stretched by an elongation of at least 10% in at least one direction to place the stretch film under pre-stretched tension before contact with said rigid base or said product; and is welded to said substantially rigid base along a sealing line while said stretch film is under at least said pre-stretched tension so as to form said hermetically sealed package.

2. The hermetically sealed package of claim 1 wherein said substantially rigid base is a tray with a recessed center portion, upwardly extending side walls, and a peripheral rim provided with a continuous flange, said thermoplastic film being heat bonded along said sealing line on said continuous flange.

3. The hermetically sealed package of claim 2 wherein said product extends above said tray side walls.

4. The hermetically sealed package of claim 1 wherein said thermoplastic film is capable of being stretched without breaking by at least about 180% of its original length, as measured according to Method A of ASTM D-882, at room temperature when a stretching force of up to about 1 kg/cm is applied thereto.

5. The hermetically sealed package of claim 1 wherein said thermoplastic film is heat shrinkable.

6. The hermetically sealed package of claim 1 wherein said substantially rigid base is a foam polymer, optionally lined with a heat sealable thermoplastic film.

7. The hermetically sealed package of claim 6 wherein said foam polymer is foamed polystyrene, foamed polypropylene, or foamed polyester.

8. The hermetically sealed package of claim 7 wherein said foam polymer is foamed polystyrene and wherein said thermoplastic film comprises in its heat-sealing layer a thermoplastic elastomer comprising mer units derived from styrene.

9. The hermetically sealed package of claim 1 wherein said product comprises poultry meat.

10. The package of claim 1 wherein said stretch film is pre-stretched by an elongation of at least 15% in at least one direction to place the stretch film under pre-stretched tension before contact with said rigid base or said product.

11. The package of claim 1 wherein said stretch film is capable of cold stretching at room temperature under the conditions of ASTM D-882 (Method A) by at least 180% of its original length without breaking when applying a stretching force of not higher than 1.5 kg/cm.

12. A method of manufacturing a hermetically sealed package for a product, comprising:

a) placing said product on a substantially rigid base;

b) pre-stretching a thermoplastic stretch film by an elongation of at least 10% in at least one direction to place the stretch film under pre-stretched tension before contact with said rigid base or said product, wherein said stretch film:

is capable of cold stretching at room temperature under the conditions of ASTM D-882 (Method A) by at least 150% of its original length without breaking when applying a stretching force of not higher than 2 kg/cm; and is capable of a permanent deformation in length in each of the machine and transverse directions of less than 20%, where the permanent deformation is measured by providing a representative film sample having original dimensions of 12.5 cm long and 2.5 cm wide, stretching the film sample lengthwise at a constant rate until 50% stretch is obtained, releasing the film sample for 30 seconds, subsequently measuring the length of the stretched film sample, and calculating the percent increase in length of the stretched film sample compared to the original film sample;

c) extending said pre-stretched stretch film over said product and base;

d) pressing said pre-stretched stretch film against said substantially rigid base along a pressure line; and e) welding said stretch film to said substantially rigid base while said stretch film is under at least said pre-stretched tension by heating along a sealing line so as to form said hermetically sealed package.

13. The method of claim 12 wherein said thermoplastic film is heat shrinkable, and further comprising the step of heating said package so as to cause said heat-shrinkable film to shrink.

14. The method of claim 12 wherein said substantially rigid base is a tray with a recessed center portion, upwardly extending side walls, and a peripheral rim provided with a continuous flange, said thermoplastic film being heat bonded along said sealing line on said continuous flange, said product optionally extending above said tray side walls.

15. The method of claim 12 wherein said product comprises poultry meat.

16. The method of claim 12 wherein said pre-stretching step places said thermoplastic film under pre-stretched tension in both longitudinal and transversal directions.

17. The method of claim 12 wherein said welding step includes heat sealing said stretch film to said substantially rigid base.

18. The method of claim 12 wherein said welding step includes ultrasonic wave or radio frequency welding said stretch film to said substantially rigid base.

19. The method of claim 12 further comprising the step of stretching said pre-stretched film beyond said pre-stretched tension by contacting the film with said product.

20. A machine for manufacturing a hermetically sealed package, comprising:

a) means for feeding a thermoplastic stretch film;

b) means for advancing said film over a substantially rigid base bearing a product to be packaged while pre-stretching said film by an elongation of at least 10% in at least one direction to place the film under pre-stretched tension before contact with said rigid base or said product;

c) a first frame capable of pressing said film against said substantially rigid base along a pressure line; and d) a second frame capable of welding said thermoplastic film to said substantially rigid base along a sealing line while said film is under at least said pre-stretched tension so as to form a hermetically sealed package.

21. The machine of claim 20 wherein said advancing means comprises a pinching roll and two partially diverging grip chains.

* * * * *